United States Patent [19]

Mills

[11] Patent Number: 4,866,851

[45] Date of Patent: Sep. 19, 1989

[54] BUILDING BLOCK GUIDE WITH HAND-CRANKED CLAMPING MEANS

[76] Inventor: Norman J. Mills, 820 Aspen Rd., West Palm Beach, Fla. 33409

[21] Appl. No.: 232,272

[22] Filed: Aug. 15, 1988

[51] Int. Cl.[4] ..... G01C 15/10

[52] U.S. Cl. ..... 33/410

[58] Field of Search ..... 33/404, 406, 407, 408, 33/409, 410

[56] References Cited

U.S. PATENT DOCUMENTS 458,464 8/1891 Kelley ..... 33/410
4,651,495 3/1987 Scarano ..... 33/410 X

FOREIGN PATENT DOCUMENTS 217045 12/1955 Australia ..... 33/404
104065 9/1926 Austria ..... 33/406

*Primary Examiner*—Harry N. Haroian
*Attorney, Agent, or Firm*—Victor F. Volk

[57] ABSTRACT

For constructing walls of building blocks and the like a device is provided that can be clamped down upon a corner block by turning a hand crank at the top of a long rod that extends above the top of the wall. Slide grips for a running line are provided that fit vertical flanges on the device.

8 Claims, 3 Drawing Sheets

BUILDING BLOCK GUIDE WITH HAND-CRANKED CLAMPING MEANS

BACKGROUND OF THE INVENTION

In constructing a building wall of multiple courses of brick a bricklayer usually works from scaffolding constructed at the wall side outside of the building. The bricks are each deposited over a running line that has been set to mark the edge of the course. When a wall is built of concrete blocks, however, the mason usually builds it from inside the building line. In either case two corners are established first to locate the running line, and particular skill has been required of masons to build the corners true. It is a purpose of the present invention to provide a device that will enable less skilled persons to build true corners and set running lines, particularly for building block walls from the inside.

In U.S. Pat. No. 4,656,753 to Chesworth a post socket is described wherein two plates are clamped into the corner of a wall by tightening nuts on three legs that tie the plates together. A post can then be leveled and locked into this socket and running lines attached to the post. Chesworth's tightening nuts are located at his upper plate, and when the device must be removed to prepare for a second layer of courses the bricklayer must descend to the bottom of the wall to release the nuts. Particularly, if a mason is working on the building side of the wall, this will be very time consuming operation.

U.S. Pat. No. 3,017,701 to Jernigan describes a story pole comprising a flanged angle but without any suggestion of the applicant's present integral clamp. In Jernigan's implement the bricks do not corner against the walls of the angle legs, as with the applicant's device, but abut against intricate channel-shaped abutments extending from the legs.

SUMMARY OF THE INVENTION

My combination of cornering device and running line for use in constructing building walls comprises a structural angle formed of two vertical legs each comprising line-connecting means, such, preferably as a lengthwise flange extending from its edge. One of the legs of my angle comprises walls that define a vertical slot through which extends a second plate means that combines with a first plate means across the bottom of the angle to constitute a clamp. The second plate means comprises walls that define a guide hole that fits closely around a vertical rigid elongated guide means that is fixed to the angle by brackets.

My device also comprises a long vertical rod with an area of spiral threads. This rod engages the second plate means either by having the second plate engage the threads, as with a threaded hole in the plate, or being rotatably fitted to a fixed point of the rod. In the latter case I attach a threaded bracket to the angle so that rotation of the rod will move it vertically, together with the second plate. Cranking means, such as a hand grip, are mounted on the rod, preferably at its top, at a position above the top of the angle, so that it can be reached as the wall is built up, by a mason on the building side of the wall.

For connecting a running line I have invented a synthetic polymeric member with walls that define a deep channel that slidably fits one of the flanges. The surface of this member that extends in one direction from the channel comprises a line-guiding groove, and the surface that extends in the opposite direction is relieved to the thickness of the leg.

I have also originated the method of constructing a building wall that comprises the steps of setting up two building blocks, clamping one of my devices, herein described, to a corner of each of these blocks. In my method there are laid a series of courses of blocks between these devices, using running lines between the devices as guides and raising the lines after each course until the tops of the angles of the devices are reached. In my method the devices are then loosened by turning cranks thereon from the the inside of the wall, laying new corner blocks atop the last course, and then affixing the devices to the corners of the newly laid corner blocks. Repeated layers of courses are then laid as desired.

DETAILED DESCRIPTION OF PREFERRED EMBODIMENT

Figure 2:
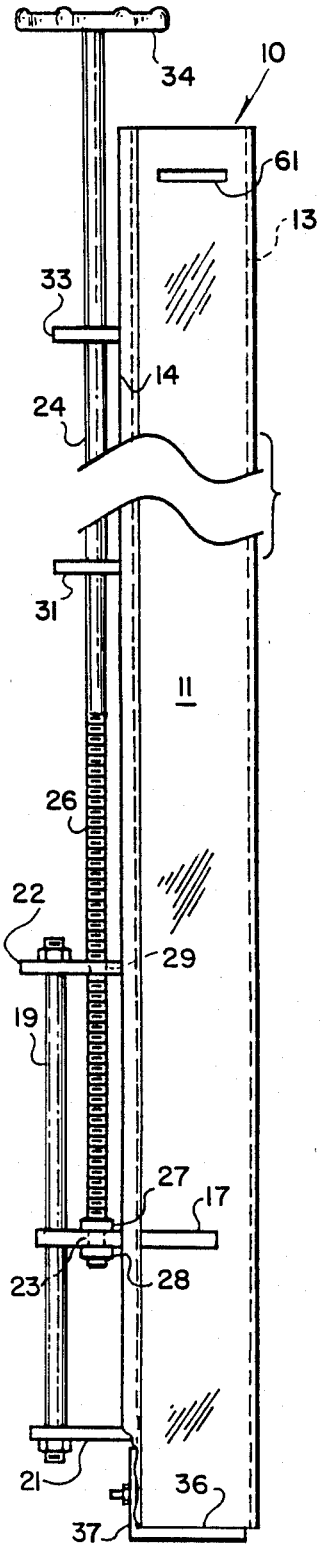
FIG. 2 is a side elevation of the device of FIG. 1.
Figure 1:
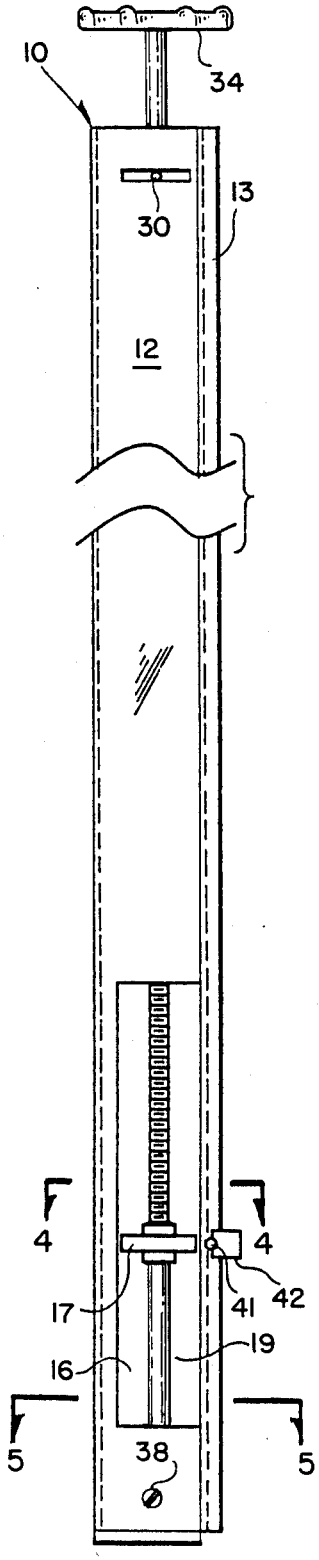
FIG. 1 is a front elevation of the device of my invention.
Figure 3:
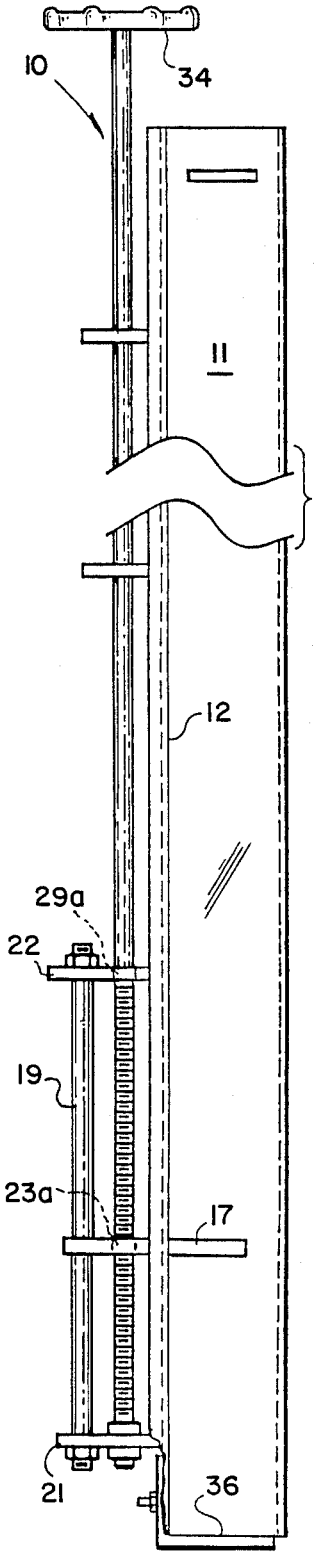
FIG. 3 is a side elevation of another embodiment of the device of FIG. 1.
Figure 4:
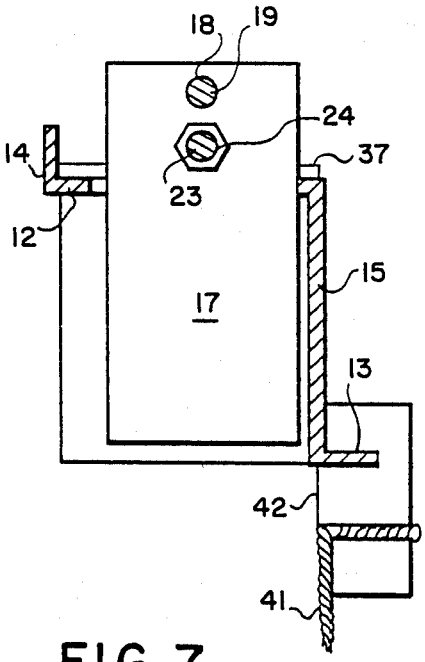
FIG. 4 is a section through the lines 4—4 of FIG. 1.
Figure 5:
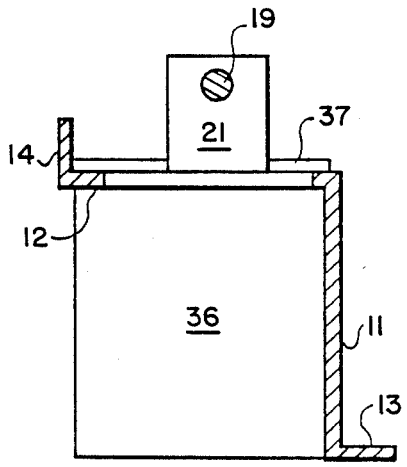
FIG. 5 is a section through the lines 5—5 of FIG. 1.

Referring first to FIGS. 1–3 my device 10 is shown upright as it would be applied to a corner block (not shown). The device 10 comprises a structural angle 15, best seen in section in FIG. 5, formed of the two legs 11, 12. The leg 11 has a lengthwise right-angled flange 13 and the leg 12 a similar flange 14. In the preferred embodiment illustrated the elements of the device 10 so far described are economically formed of an integral length of extruded aluminum, with the thickness of the flanges 13, 14 being less than the thickness of the legs 11, 12. The wall 12 is cut away to form walls that define a rectangular vertical slot 16, and through this slot there extends a plate 17 through which there has been machined a guide hole 18 to fit a guide means in the form of a rod 19 that is fixedly attached to the leg 12 by means of bent angle brackets 21 and 22. A bearing 23 is also drilled through the plate 17 for turnably securing a vertical rod 24 of which an area 26 is threaded, two nuts 27, 28 confining the end of the area 26 to the plate 17. The rod 26 passes through a threaded hole 29 in the bracket 22 and guide holes in brackets 31, and 33 that are bent from the metal of the leg 12. The rod 24 extends above the top of the angle 15 so that it is easy to reach from the opposite side of a partially built wall of building blocks, and it is topped by a crank in the form of a circular hand grip 34. A lower plate 36 consists of one leg of an angle 37 the other leg of which is fixedly attached to the leg 12 by means of a recessed-head bolt 38. In FIG. 4 a section is shown through the device of FIG. 1 looking down upon the plate 17 and in FIG. 5 another section is shown looking down upon the plate 36. In FIG. 3 a bearing **29*a* in the plate 22 is unthreaded and a threaded hole 23*a* in the plate 17 cooperates with the threads on the rod 24 to raise or lower the plate when the rod 24** is rotated.

I have found that an angle 15 with 2-inch legs and with the flanges 13, 14 having an outside width of 0.5 inches works very well and may be 52 inches high. With six courses of 8-inch blocks this will leave ample space at the top for inserting bubble level tubes 30 of known construction. Near the top of each of the legs 11,12 slots 61,62 are cut to snugly fit a standard tubular bubble level.

Figure 7:
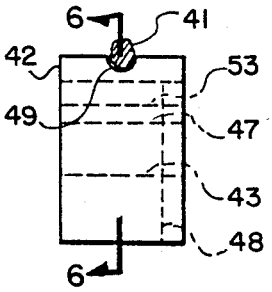
FIG. 7 is an end view ofthe slide grip of FIG. 8.
Figure 6:
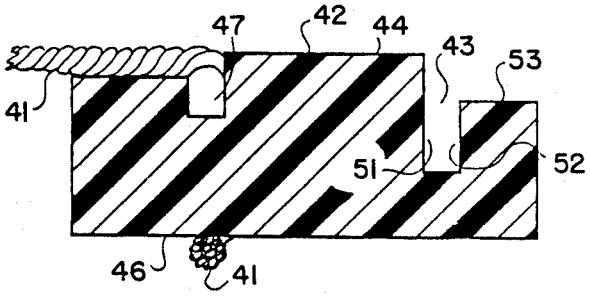
FIG. 6 is a secton through the lines 6—6 of FIG. 7.
Figure 8:
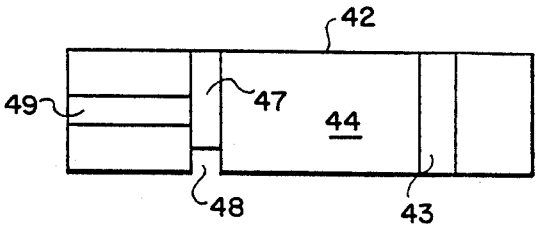
FIG. 8 is a plan view of the slide grip of my invention.

A running line 41 (FIG. 6) is held by a slide grip 42 preferably made from synthetic polymeric material of which a number of suitable types are commercially available. This slide grip is detailed in FIGS. 6–8 and has a deep channel 43 of sufficient depth to accept one of the flanges 13 or 14 and a width matching the width of that flange in a snug slide fit. The slide grip serves as an anchor for the running line 41 and will be slid up the flange as courses of building blocks are added to the wall being built. Normal surfaces 44, 46 (FIG. 8) are respectively notched at 47, 48 to hold the line 41 and the surface 44 is coplanar the inner surface of the leg 11. A groove 49 cut or molded into the surface 44 serves to guide the line 41 which has been wrapped around the grip 42 in the notches 47, 48 and knotted. Walls 51, 52 of the channel 43 are spaced just far enough apart to provide a firm slide fit on the flanges 13 or 14, and the surface 44 is relieved at 53 an amount equal to the thickness of the leg 13 so that the surface 44 can match the surface of the leg and thus correspond to the edge of a building block that has been fitted into the corner formed by the angle 15.

The device so far described, with the flanges 13, 14 to support running lines, is preferred and has the important advantage that, in manufacture, the angle with the flanges is extruded in a single operation. The flanges also add to the columnar stiffness of the angle. Other means of attaching running lines to the angle legs are possible, such as having the edges of the legs perforated so that the lines might be attached by suitable hooks.

A distinct advantage of my device resides in the shallow extend of the plates 36 and 17 which do not require too great an area to later be filled in with mortar. In practice, my device 10 can be clamped so firmly to a corner block even with shallow plates, that it is in no danger of shifting as the building of a wall progresses.

Figure 9:
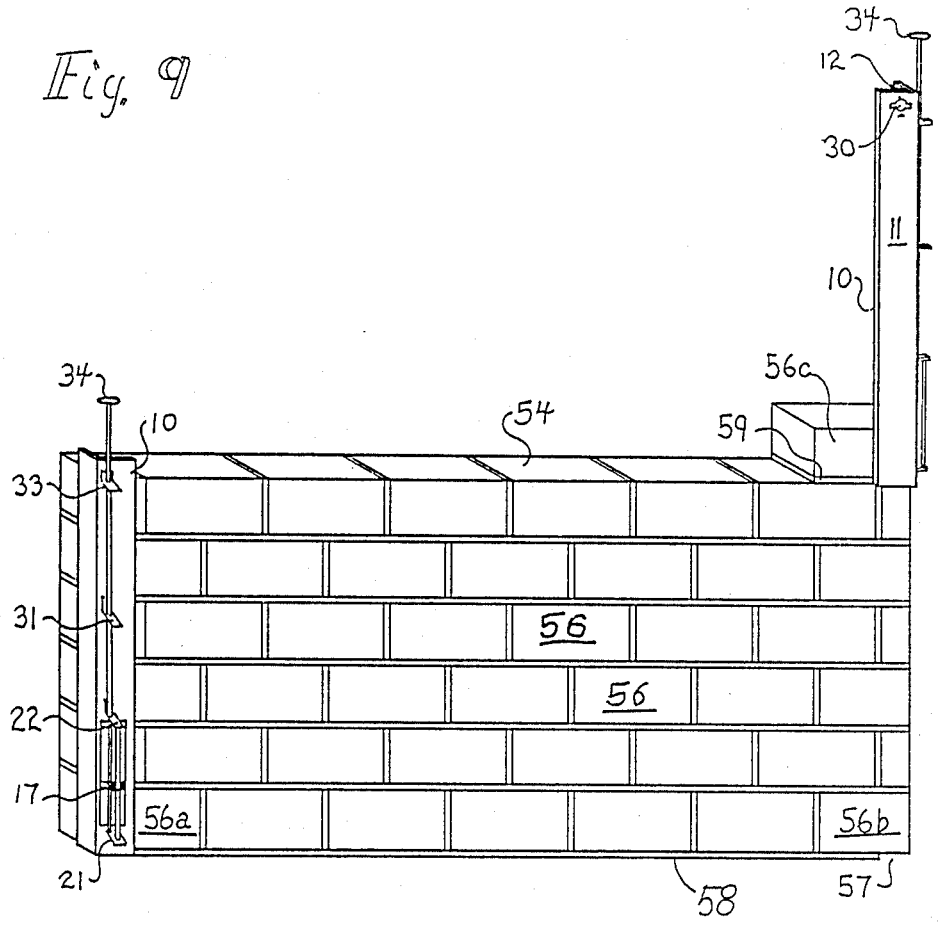
FIG. 9 is a pictorial view of a wall under construction by means of my invention.

In FIG. 9 the method of using my invention is illustrated. Here a wall 54, constructed, so far, of six courses of blocks 56—56 has had the devices 10 clamped to corner blocks **56*a* and 56*b* during its construction and preparation is being made for a higher set of courses. For this purpose one of the devices 10 has been released, leaving an open spot 57 in a mortar bed 58 between the lowest course and its foundation. The device 10 has then been fitted to a corner block 56*c* of the new set of courses, a space having been left in a mortar bed 59 to receive the plate 36. The other of the devices 10 will now also be released and raised for attachment to a new block facing the block 56*c*. The line 41, which is not shown in FIG. 9 will then be attached to both of the devices 10**, as has been explained.

The foregoing description has been exemplary rather than definitive of my invention for which I desire an award of letters patent as defined in the appended claims.

I claim:

1. The combination of a cornering device and running line for use in constructing a building wall comprising:

(A) a structural angle comprising two vertical legs, each of said legs comprising line-connecting means, and one of said legs comprising walls defining a vertical slot, (B) at least one running line, said running line being connected to said connecting means, (C) first substantially horizontal plate means fixedly attached across the bottom of said angle and second substantially horizontal plate means extending movably through said slot, said second plate means comprising walls defining a hole spaced outwardly from said angle, (D) rigid elongated guide means, said guide means closely fitting said hole, and bracket means fixing said guide means to said angle, (E) a vertical rod, said rod comprising an area of spiral threads, said rod engaging said second plate means, bracket means rotatably mounting said rod to said angle, said rod extending to a point above said angle, and cranking means mounted on said rod above said angle whereby turning said rod effects vertical movement of said second plate means.

2. The combination of claim 1 wherein said line-connecting means comprises flanges extending from the edges of said legs.

3. The combination of claim 1 comprising means on said second plate means engaging said area of spiral threads.

4. The combination of claim 3 wherein said means engaging said area of spiral threads comprises a threaded hole through said second plate.

5. The combination of claim 1 comprising a plate projecting outwardly from said angle, said plate comprising a threaded hole engaging said threaded area of said rod, said rod rotatably securing said second plate means so as to move it vertically therewith.

6. The combination of claim 2 comprising a plate projecting from said angle, said plate comprising a threaded hole engaging said threaded area of said rod, said plate-comprising means rotatably securing said rod so as to move vertically therewith.

7. The combination of claim 2 comprising a synthetic polymeric slide grip member comprising walls defining a deep channel slidably fitting one of said flanges, one wall of said channel terminating in a running-line-guiding surface coplanar to the inside surface of one of said legs, and the other wall of said channel terminating in a relieved surface planar to the outside surface of said one of said legs.

8. A slide grip member for connecting a running line to the flange of an upright angle leg, comprising a surface comprising a line-guiding groove, and walls defining a deep channel slidably fitting said flange, said surface being relieved from the outer wall of said channel to the thickness of said leg.

* * * * *